US005254134A

United States Patent [19]

Zhao et al.

[11] Patent Number: 5,254,134

[45] Date of Patent: Oct. 19, 1993

[54] TEXTILE-FINISHING AGENT

[75] Inventors: Zhong Z. Zhao, Munich; Tjoei H. Chu, Maria Ward Str. 24, 8000 Munich 19, both of Fed. Rep. of Germany

[73] Assignee: Tjoei H. Chu, Munich, Fed. Rep. of Germany

[21] Appl. No.: 820,073

[22] Filed: Jan. 13, 1992

[30] Foreign Application Priority Data

Jan. 11, 1991 [DE] Fed. Rep. of Germany ..... 4100703

[51] Int. Cl.[5] ..... B32B 33/00; D06M 13/11

[52] U.S. Cl. ..... 8/120; 8/128.3; 8/115.64; 252/8.9; 427/386; 428/245; 428/270; 428/272; 428/274; 428/907

[58] Field of Search ..... 8/120, 128.3, 115.64; 252/8.9; 428/245, 270, 272, 274, 907; 427/386

[56] References Cited

U.S. PATENT DOCUMENTS

| | | | |
|---|---|---|---|
| 4,184,004 | 1/1980 | Pines et al. . | |
| 4,283,191 | 8/1981 | Koerner et al. | 8/128.3 |
| 4,405,328 | 9/1983 | Nickel et al. | 8/128.3 |
| 4,408,996 | 10/1983 | Baldwin . | |
| 4,414,268 | 11/1983 | Baldwin | 428/289 |
| 4,537,595 | 8/1985 | Gruning et al. | 8/128.3 |
| 4,895,917 | 1/1990 | Gruning . | |

FOREIGN PATENT DOCUMENTS

| | | |
|---|---|---|
| 0135471 | 3/1985 | European Pat. Off. . |
| 0143980 | 6/1985 | European Pat. Off. . |
| 0292963 | 11/1988 | European Pat. Off. . |
| 0332397 | 9/1989 | European Pat. Off. . |
| 0351957 | 1/1990 | European Pat. Off. . |
| 33049 | 9/1988 | Fed. Rep. of Germany . |
| 0313867 | 5/1989 | Fed. Rep. of Germany . |
| 3802622C2 | 11/1989 | Fed. Rep. of Germany . |

*Primary Examiner*—James C. Cannon
*Attorney, Agent, or Firm*—Bacon & Thomas

[57] ABSTRACT

A textile finishing agent is described which contains a water-soluble polysiloxane with polyether and epoxypolyether lateral chains and preferably moreover an antimicrobial substance, a crosslinking agent and catalysts.

8 Claims, No Drawings

TEXTILE-FINISHING AGENT

The invention concerns a textile-finishing agent and a method for finishing textiles.

Natural, untreated textiles as a rule do not meet the high requirements demanded of textiles. Accordingly they are treated chemically to impart the desired properties to them. The chemicals used for this purpose are termed "finishing agents."

The known finishing agents are hardly ever universally applicable for all conventional textile base materials. Therefore, different finishing agents are needed for cellulose textiles than are needed for textiles made of keratin fibers (for instance wool) or from synthetic fibers such as polyesters.

Regarding cellulosic textiles, finishing agents which have been found useful in the past are based on N-hydroxymethyl or N-methoxymethyl compounds which release formaldehyde under the conditions of use and which more or less crosslink the cellulosic material.

Meanwhile, several countries have adopted laws substantially restricting the use of finishing agents which contain formaldehyde or release it and which prohibit such agents for use in specific textiles such as infant wear or garments worn directly against the skin.

It is therefore the object of the present invention to provide textile-finishing agents which are universally applicable for all conventional textile base materials and which are free from formaldehyde or from formaldehyde-releasing compounds. In particular, it is the object of the invention to provide a finishing agent of the above kind that shall impart anti-microbial properties, freedom from creasing, a soft feel and good air-permeability to the textile and make it substantially wash-fast.

This problem is solved by a finishing agent containing a water-soluble polysiloxane, which is characterized by a polysiloxane of general formula I,

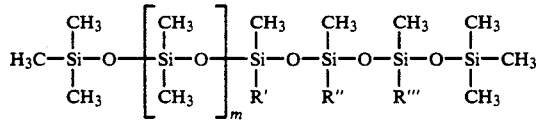

where R′ is a polyether residue consisting of —CH-$_2$—$CH_2$—O— and/or —$CH_2$—$CH_2$—$CH_2$—O— units, R″ is an epoxy polyether residue of which the polyether chain corresponds to that of R′, R‴ is a polyethoxy residue, and m is an integer of about 1,000 to 3,000 and where the sequence of the units denoted by m, R′, R″, R‴ is arbitrary.

Preferred polysiloxanes of the above formula I are those wherein the polyether residue R′ contains about 50 to 200 units of the stated formulae; wherein the epoxy polyether residue R″ comprises about 1 to 10 epoxy groups; and the polyethoxy residue R‴ comprises about 50 to 200 ethoxy units.

The residues R′, R″ and R‴ accordingly can be characterized by the following formulae:

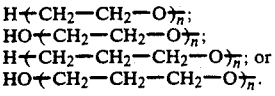

-continued

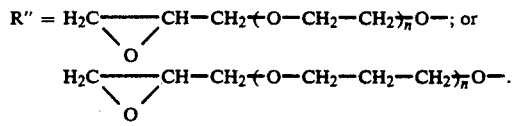

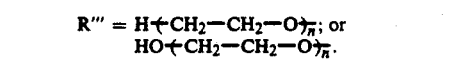

In the above formulae, "n" always is an integer from about 50 to 200 and the epoxy group in the residue R″ occurs repeatedly, for instance twice to 10-fold.

Preferably the polysiloxane of formula I has a molecular weight between 100,000 and 300,000, in particular a molecular weight of 200,000 to 250,000. This polysiloxane is very water-soluble, and at least shall be easily dispersed or emulsified in water. The methyl siloxane units with residues R′, R″ and R‴ also may occur repeatedly in the molecule. In that case the lateral chains R′, R″ and R‴ may be accordingly shorter or the number "m" of the dimethylsiloxane units can be reduced correspondingly.

The polysiloxanes of the general formula I are prepared by conventional methods, for instance by cohydrolysis and ensuing condensation of various organosilicon halides— see ULLMANN'S ENCYKLOPAEDIE DER TECHNISCHENCHEMIE, 4th ed., vol. 21, pp 500.

The textile-finishing agent of the invention moreover preferably contains an antimicrobial substance, a crosslinking agent and at least one catalyst.

Preferably dodecyl-dimethyl-benzyl ammonium chloride of formula II is used as the antimicrobial substance,

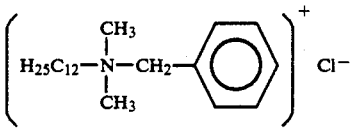

The crosslinking agent preferably is $\alpha,\omega$-bisepoxypropyl-hexamethylene diamine of formula III:

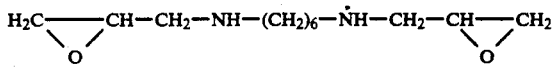

Preferably acetic acid and magnesium chloride are used as catalysts.

The agent of the invention preferably is used in aqueous solution. Preferably a ready-to-use aqueous solution shall contain:

0.2 to 2% by weight polysiloxane,
0.5 to 4% by weight antimicrobial substance,
0.2 to 2% by weight crosslinking agent,
0.4 to 2% by weight acetic acid, and
0.4 to 2% by weight magnesium chloride.

An especially preferred implementation of the agent of the invention contains the following in aqueous solution:

0.5 to 1% by weight polysiloxane,
1 to 2% by weight antimicrobial substance,
0.5 to 1% by weight crosslinking means,
0.8 to 1% by weight acetic acid, and 0.8 to 1% by weight magnesium chloride.

The above contents are the operational contents in aqueous solution, that is, in aqueous liquor. Obviously the agent also may be handled in the form of a concentrated stock solution from which the operational liquor shall be prepared by dilution with water. Preferably, the agent shall be stored undiluted in the form of a binary or three-component package. For example, the antimicrobial substance and the catalysts may be combined and stored in common and the polysiloxane and the crosslinking agent each may be added from separate packages. Preferably, the components are combined immediately before being used in aqueous solution.

The method of the invention for finishing textiles is carried out in such a way that the above stated components are dissolved in the above stated weight ratios, if called for, in the presence of conventional additives, whereupon the textile is treated with the solution. Preferably the textile shall be thoroughly soaked with the solution and thereupon a specified liquor content shall be set by compression, for instance in a padding mangle. Then drying with heating is carried out, and the temperature at the end is raised higher. Preferably, drying takes place at 70° to 100° C., the time of drying then being about 5 to 15 minutes, preferably 6 to 10 minutes. In the last phase, the temperature is raised for 20 to 90 seconds to 110° to 120° C., preferably to 115° C., after which the assembly is allowed to age for about 24 hours at 20°-25° C.

The agent of the invention is very well absorbed by all natural textiles such as cotton, wool and silk, but also by synthetics. It is self-crosslinking and thereby it bonds hard to the textile, this feature being reflected by unusually high wash-fastness. The agent imparts a pleasant, soft feel to the fabric, does not affect the fabric dye, is highly compatible physiologically and can be applied, for instance by impregnating, conventionally with conventional equipment.

A highly advantageous implementation of the agent of the invention consists in combining it with the above crosslinking agents and with the stated catalysts.

An antimicrobial substance is especially advantageous when combined with the method of the invention, in particular the above-mentioned dodecyldimethylbenzyl ammonium chloride. Surprisingly, the total combination described herein of organo-polysiloxane, crosslinking agent, catalysts and antimicrobial substances results in highest-grade textile finishing.

This finishing protects against moth infestation and mildew and inhibits or kills most pathogenic agents, for instance:

*Staphylococcus aureaus* (with or without drug resistance)
*Staphylococcus albus,*
*Candida albicans,*
*Bacillus subtilis,*
*Bacillus coli,*
*Bacillus pyocyaneus,*
*Bacillus dysenteriae,*
*Bacillus enteritidis,*
*Bacillus typhosus,*
*Bacillus proteus,*
*Bacillus anthracis.*

This antimicrobial finishing is highly effective, exceedingly wash-fast and body-compatible. Therefore it may be used very well both industrially and hygienically.

Industrially it is applicable mostly to finishing tent materials, covering canvases, bag and filter materials etc, that are exposed for lengths of time to strong weather factors. In this manner they are well protected against mildewing, rotting, discoloration and any kind of biological and enzymatic damage to fibers.

In the sanitary area, for example, textiles used in clinics, garments and households may be provided with this finishing. Textiles so finished prevent transmission of pathogenic microbes and also odors caused by microbial breakdown. Textiles of this kind therefore also act as deodorants for instance in refrigerators, storage spaces, toilets and baths.

A cotton fabric treated with such finishing was tested for its washfastness and antimicrobial efficacy relative to various typical pathogens. The results are summarized in Tables 1 and 2 below.

TABLE 1

| Fabric | No. of wash cycles | *Staphylococcus-aureaus* | *Bacillus coli* | *Bacillus pyocyaneus* | *Bacillus* subtilis* |
|---|---|---|---|---|---|
| untreated | 0 | 756 | >1,000 | >1,000 | >1,000** |
| Treated | 20 | 0 | 0 | 0 | 0 |
| with the | 30 | 0 | 0 | 0 | 0 |
| liquor of | 40 | 0 | 0 | 0 | 0 |
| Example 1 | 50 | 0 | 0 | 0 | 0 |
| | 60 | 0 | 0 | 0 | 0 |

*all strains are standard
**number of bacteria per 4.8 cm diameter plaque

TABLE 2

| [No. of wash cycles] → ↓ [Bacterial strains] | 10 | 20 | 30 | 40 | 50 | 60 | untreated |
|---|---|---|---|---|---|---|---|
| *staphylococcus aureus* | 32.5 | 32 | 32 | 31.5 | 31.5 | 31 | 0 |
| *bacillus coli* | 32.5 | 31.5 | 31.5 | 30 | 29.5 | 28 | 0 |
| *bacillus pyocyaneus* | 33 | 33 | 32.5 | 31.5 | 29.5 | 29 | 0 |
| *bacillus subtilis* | 34 | 33 | ° 31 | 30 | 28 | 27.5 | 0 |
| | | | | ← a → | | | |

a) diameter in mm of bacteriostatic inhibition zone
b) rating the inhibition zone:
10-15 mm good
15-20 mm very good
>20 excellent The following Examples elucidate the invention without however restricting it thereby.

EXAMPLE 1

(a) Preparing the liquor 6 g polysiloxane defined on p 2 and with a molecular weight of 230,000, 15 g dodecyl-dimethyl-benzyl ammonium chloride, 7 g bis-epoxypropyl-hexamethylene diamine, 9 g of 98% acetic acid and 9 g magnesium chloride are dissolved in 700 ml softened line water, and water is added to fill to 1,000 g.

(b) Applying the liquor 100 g of a bleached cotton fabric such as used for physician smocks are dipped into the above liquor and are moved several times to and fro in this liquor to remove air bubbles and to fully impregnate the fabric; this fabric is removed after about 30 to 60 seconds. It is allowed to drip a few seconds and the excess liquid is removed between squeezing rollers, the moisture content being set to 70%. Drying then ensues for 6 to 10 minutes at 70° to 110° C. followed by heating for 40 to 60 seconds to 115° C., and lastly the fabric so treated is left to age for 24 hours at 20°-25° C.

The finishing so achieved is unusually wash-fast and antimicrobial. The above test results were obtained from a fabric of this kind.

EXAMPLE 2

150 g of a dyed silk fabric of conventional lining quality are dipped into one liter of the liquor obtained according to Example 1 and are moved therein for a few seconds to achieve full wetting and impregnation. The fabric is then removed, allowed to drip and the excess liquor is removed between squeezing rollers, the moisture content being set to 60%. Drying ensues at 70° to 100° C. for 6 to 8 minutes and the temperature is raised to 115° C. for 30 to 40 seconds. The material then is allowed to age for 24 hours at 20°-25° C.

The finishing so prepared is just as wash-fast as the one described above and its microbial efficacy is unchanged even after about 60 wash cycles.

We claim:

1. A textile finishing composition comprising (a) a water-soluble polysiloxane of formula 1,

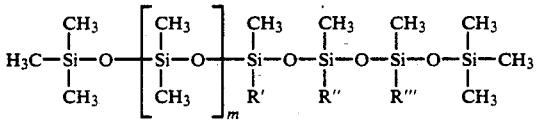

where R′ is a polyether residue consisting of —$CH_2$—$CH_2$—O— and/or —$CH_2$—$CH_2$—$CH_2$—O— units, R″ is an epoxy polyether residue of which the polyether chain corresponds to that of R′, R‴ is a polyethoxy residue, and m is an integer of about 1,000 to 3,000, the sequence of the units denoted by m, R′, R″ and R‴ being arbitrary;

(b) dodecyl-dimethyl-benzyl ammonium chloride as an antimicrobial substance;

(c) bisepoxypropyl-hexamethylene diamine as a cross-linking agent; and (d) acetic acid and magnesium chloride as a catalyst.

2. A composition as claimed in claim 1 which comprises, in aqueous solution,

| | |
|---|---|
| 0.2 to 2% by weight | polysiloxane |
| 0.5 to 4% by weight | antimicrobial substance, |
| 0.2 to 2% by weight | crosslinking agent |
| 0.4 to 2% by weight | acetic acid, and |
| 0.4 to 2% by weight | magnesium chloride. |

3. A composition as claimed in claim 1 which comprises

| | |
|---|---|
| 0.5 to 1% by weight | polysiloxane |
| 1 to 2% by weight | antimicrobial substance, |
| 0.5 to 1% by weight | crosslinking agent |
| 0.8 to 1% by weight | acetic acid, and |
| 0.8 to 1% by weight | magnesium chloride. |

4. A method for finishing textiles, wherein a liquor is prepared by (a) emulsifying or dissolving in water the composition of claim 1;

(b) optionally adding conventional additives;

(c) impregnating the textile with the liquor;

(d) squeezing out the liquor from the impregnated textile down to a specified value;

(e) drying the textile material by heating; and (f) raising the textile material briefly to a higher temperature.

5. A method as claimed in claim 4, wherein from 0.2 to 2% by weight of polysiloxane, referred to the total weight of the liquor, is used.

6. A method as claimed in claim 5, wherein from 0.5 to 1% by weight of polysiloxane, referred to the total weight of the liquor, is used.

7. A finished textile material which has been treated with a composition according to claim 1.

8. A finished textile material which has been treated with a composition according to claim 2.

* * * * *